United States Patent [19]

Shimizu et al.

[11] Patent Number: 4,578,319

[45] Date of Patent: Mar. 25, 1986

[54] SURFACE TREATED STEEL SHEET HAVING AN EXCELLENT WELDABILITY AND ITS PRODUCTION METHOD

[75] Inventors: Nobuyoshi Shimizu; Terunori Fujimoto; Tsuneo Inui; Masatoki Ishida, all of Yamaguchi, Japan

[73] Assignee: Toyo Kohan Co., Ltd., Tokyo, Japan

[21] Appl. No.: 782,262

[22] Filed: Sep. 30, 1985

Related U.S. Application Data

[62] Division of Ser. No. 608,088, May 8, 1985.

[51] Int. Cl.[4] ..... C25D 5/12

[52] U.S. Cl. ..... 428/632; 428/629; 428/648; 428/660; 428/666; 428/667

[58] Field of Search ..... 428/632, 629, 648, 660, 428/666, 667

[56] References Cited

U.S. PATENT DOCUMENTS 4,481,264 11/1984 Faure ..... 428/667

4,511,631 4/1985 Fujimoto ..... 428/632

*Primary Examiner*—Veronica O'Keefe

*Attorney, Agent, or Firm*—Wenderoth, Lind & Ponack

[57] ABSTRACT

Surface treated steel sheet having three layers consisting of a bottom layer of metallic chromium, a middle layer of metallic tin or tin-nickel alloy and a top layer of hydrated chromium oxide on a steel base, and a method for the continuous production of this surface treated steel sheet which comprises; (1) chromium plating on a steel base to form a layer of metallic chromium and hydrated chromium oxide, (2) tin plating by using a tin plating electrolyte having a low concentration of stannous ion or tin-nickel alloy plating by using a known tin-nickel alloy plating electrolyte, said electrolytes have a low current efficiency for tin or tin-nickel alloy plating, thereby removing said layer of hydrated chromium oxide from said chromium plated steel base; and (3) forming a layer of hydrated chromium oxide by a chromate treatment by using an acidic electrolyte containing hexavalent chromium ion.

Instead of the process (2) in the above method, a cathodic treatment of chromium plated steel base in an acidic solution having a pH of 0.5 to 2.0 can be carried out for the removal of hydrated chromium oxide formed during chromium plating, and thereafter, tin or tin-nickel alloy plating by using a known tin or tin-nickel alloy plating electrolyte can be performed.

By using this surface treated steel sheet, a welded can body can be produced at high speed without the removal of the plated layer in the welded part since it has an excellent weldability.

2 Claims, No Drawings

SURFACE TREATED STEEL SHEET HAVING AN EXCELLENT WELDABILITY AND ITS PRODUCTION METHOD

This is a Rule 62 divisional of Ser. No. 608,088 filed May 8, 1985.

FIELD OF THE INVENTION

The present invention relates to a surface treated steel sheet having an excellent weldability and an excellent corrosion resistance and a method for its production.

In detail, the invention relates to a surface treated steel sheet having three layers consisting of a bottom layer (layer closest to the steel base) of metallic chromium a middle layer of metallic tin or tin-nickel alloy and a top layer (layer farthest from the steel base) of hydrated chromium oxide on a steel base, and a method for production of this surface treated steel sheet which is characterized by tin plating by using a tin plating electrolyte having a low concentration of stannous ion or tin-nickel alloy plating by using a known tin-nickel alloy plating electrolyte which has a low current efficiency for tin or tin-nickel alloy plating or by tin or tin-nickel alloy plating by using a known tin or tin-nickel alloy plating electrolyte after a removal of hydrated chromium oxide formed during chromium plating by using an acidic solution having a pH of 0.5 the 2.0.

By using this surface treated steel sheet, a welded can body can be produced at high speed without the removal of the plated layer in the welded part.

BACKGROUND AND OBJECTIVE

Recently the change from expensive electrotinplates to cheaper tin free steel (TFS-CT) having double layers consisting of a lower layer of metallic chromium and an upper layer of hydrated chromium oxide as well as a decrease in the weight of the tin coating in electrotinplates has rapidly taken place in the field of food cans.

This is because the tin used for the production of tinplate is very expensive and there is concern over the exhaustion of tin resources.

An ordinary metal can consists of two can ends and a single can body, except for drawn cans. In the case of tinplate, the scaming of the can body is generally carried out by soldering. In this soldering process, however, it is impossible to decrease the weight of tin coating on the tinplate to under 2.8 g/m$^2$, because it is difficult to stabilize the soldering process when the weight of the tin coating is under 2.8 g/m$^2$. From the regulation of lead content in the solder used for the seaming of the tinplate can body in the field of food cans, the seaming of the tinplate can body is widely carried out by electric welding.

A lap seam welding, for instance, the Soudronic process, has been recently used for the seaming of the tinplate can body.

In this process, it is desirable to decrease the tin coating weight in the tinplate, but the weldability of tinplate becomes poor with a decrease of the tin coating weight.

On the other hand, the seaming of a TFS-CT can body is generally carried out with nylon adhesives by using the Toyo Seam (Trade name) and Mira Seam (Trade name) method.

Another method of seaming a TFS-CT can body by electric welding is also well known. In the case of the seaming of a TFS-CT can body by electronic welding, however, the metallic chromium layer and the hydrated chromium oxide layer must be mechanically or chemically removed from the TFS-CT surface in order to easily weld the TFS-CT can body at high speed. Therefore the corrosion resistance in the welded part of the TFS-CT can body becomes remarkably poor, even if this welded part is coated with lacquer after welding.

From the background described above, the development of a can material which is cheaper than tinplate and is easily welded at high speed without the removal of the plated layer, has been required in the field of food cans.

Recently, various surface treated steel sheets have been proposed as a can material which can be easily welded at high speed without the removal of the plated layer. For instance, the following surface treated steel sheets have been proposed: (a) Lightly tin coated steel sheet (LTS) with below about 1.0 g/m$^2$ of tin which is reflowed or unreflowed after tin plating (Japanese Patent Publication Nos. Sho 56-3440, Sho 56-54070, Sho 57-55800, and Laid-Open Japanese Patent Application Nos. Sho 56-75589, Sho 56-130487, Sho 56-156788, Sho 57-101694, Sho 57-185997, Sho 57-192294, Sho 57-192295 and Sho 55-69297). (b) Nickel preplated LTS with below about 1.0 g/m$^2$ of tin (Laid-Open Japanese Patent Application Nos. Sho 57-23091, Sho 57-67196, Sho 57-110685, Sho 57-177991, Sho 57-200592 and Sho 57-203797). (c) Nickel plated steel sheet with chromate film or phosphate film (Laid-Open Japanese Patent Application Nos. Sho 56-116885, Sho 56-169788, Sho 57-2892, Sho 57-2895, Sho 57-2896, Sho 57-2897, Sho 57-35697 and Sho 57-35698). (d) TFS-CT having double layers consisting of a lower layer of metallic chromium and an upper layer of hydrated chromium oxide which is obtained by some special methods such as cold rolling after TFS treatment (Laid-Open Japanese Patent Application No. Sho 55-48406), porous chromium plating (Laid-Open Japanese Patent Application No. Sho 55-31124) and a cathodic treatment of a steel sheet in chromic acid electrolyte with fluoride but without anions such as sulfate, nitrate and chloride ion (Laid-Open Japanese Patent Application No. Sho 55-18542).

However, LTS and nickel preplated LTS above-identified as (a) and (b) are slightly more expensive than TFS-CT.

Furthermore, these have not only a narrower available current range for sound welding than that in tinplate, but also poor lacquer adhesion compared with that in TFS-CT, although these can be welded without the removal of the plated layer. The reason why the available current range for sound welding in LTS and nickel preplated LTS is narrower than that in tinplate is considered to be that the amount of free tin in these is smaller than that in tinplate and also further decreases because of changes of free tin to iron-tin alloy by heating for lacquer curing. Nickel plated steel sheet with chromate film or phosphate film above-identified as (c) also has a narrower available current range for sound welding than that of LTS or nickel preplated LTS. Furthermore, the corrosion resistance of nickel plated steel sheet is poorer than that of TFS-CT, although the lacquer adhesion of nickel plated steel sheet is good. Particularly, pitting corrosion in the defective part of the lacquered nickel plated steel sheet may occur easily from acidic foods such as tomato juice because the electrochemical potential of nickel is more noble than that of the steel base and metallic chromium.

It is considered that the welding of TFS-CT shown above in (d) without the removal of the TFS-CT film at high speed is very difficult because the oxide films having high electric resistance are formed by the oxidation of metallic chromium and exposed steel base through the plating pores by the dehydration of hydrated chromium oxide during heating for curing the lacquer coated on the TFS-CT can body, although TFS-CT shown in (d) may be welded when it is not heated before welding.

As described above, various surface treated steel sheets proposed in (a), (b), (c) and (d) have various problems in their production cost and their characteristics as a can material which can be easily welded without the removal of the plated layer at high speed.

Accordingly, it is the first objective of the present invention to provide a surface treated steel sheet having excellent weldability, that is, easily being welded without the removal of the plated layer at high speed, and having excellent corrosion resistance after lacquering such as in a TFS-CT.

It is the second objective of the present invention to provide a method for the continuous production of a surface treated steel sheet having an excellent weldability.

BRIEF DESCRIPTION OF THE INVENTION

The first objective of the present invention can be accomplished by providing a surface treated steel sheet having three layers consisting of a bottom layer of metallic chromium, a middle layer of metallic tin or tin-nickel alloy and a top layer of hydrated chromium oxide on a steel base.

The second objective of the present invention can be accomplished by tin or tin-nickel alloy plating on the chromium plated steel base. More specifically, the method of the present invention is characterized by tin or tin-nickel plating onto the chromium plated steel base wherein tin or tin-nickel plating is carried out at the same time with the removal of hydrated chromium oxide formed during chromium plating by using a tin plating electrolyte having a low concentration of stannous ion or a known tin-nickel alloy plating electrolyte which electrolytes having a low current efficiency for tin or tin-nickel plating. Another method of the present invention is characterized by tin or tin-nickel alloy plating onto the chromium plated steel base by using a known tin or tin-nickel plating electrolyte after the removal of hydrated chromium oxide formed during chromium plating by a cathodic treatment of the chromium plated steel base in an acidic solution having a pH of 0.5 to 2.0.

The surface treated steel sheet according to the present invention can be used in application such as food can bodies, aerosol can bodies and miscellaneous can bodies which are lacquered, except for the part to be welded, wherein excellent weldability, i.e. being easily welded without the removal of the plated layer at high speed, is required.

The surface treated steel base according to the present invention can be also used in applications wherein the lacquer coating is not carried out because it has excellent corrosion resistance. Furthermore, this surface treated steel sheet can be used in applications wherein excellent corrosion resistance after lacquering are required, such as can ends, drawn cans and drawn and redrawn cans (DR cans), besides can bodies.

DETAILED DESCRIPTION OF THE INVENTION

The steel base used for the production of the surface treated steel sheet according to the present invention can be any cold rolled steel sheet customarily used in manufacturing electrotinplate and TFS-CT. Preferably, a type of steel base for electrotinplate, as set out in ASTM A 623-76 of 1977 (Standard specification for general requirements for tin mill product), is employed as the steel base. Preferably, the thickness of the steel base is from about 0.1 to about 0.35 mm.

The surface treated steel sheet according to the present invention is produced by the following processes:

(1) Degreasing with an alkali and pickling with an acid→water rinsing→chromium plating→water rinsing→tin or tin-nickel alloy plating→water rinsing→chromate treatment →water rinsing→drying, or;

(2) degreasing with an alkali and pickling with an acid→water rinsing→chromium plating→water rinsing→the removal of hydrated chromium oxide by a cathodic treatment in an acid solution→water rinsing→tin or tin-nickel alloy plating →water rinsing→chromate treatment→water rinsing→drying.

By using these processes shown in (1) and (2), three layers consisting of a bottom layer of metallic chromium, a middle layer of metallic tin or tin-nickel alloy and a top layer of hydrated chromium oxide are formed on a steel base. In the present invention, the amount of each layer is very important in order to obtain excellent weldability, which is an objective of the present invention.

At first, the amount of metallic chromium which is the bottom layer in the surface treated steel sheet according to the present invention, should be controlled in the range of 30 to 300 mg/m$^2$. More preferably 70 to 150 mg/m$^2$. If the amount of metallic chromium is below 30 mg/m$^2$, excellent weldability and excellent corrosion resistance are not obtained because it is considered that the surface of the steel base is not sufficiently covered with the plated metallic chromium and a greater part of the following plated tin or tin-nickel alloy changes to iron-tin alloy or iron-tin-nickel alloy having high electric resistance during heating for lacquer curing. The amount of metallic chromium is limited to 300 mg/m$^2$ from an economical and an industrial point of view, although the oxidation of a steel base and the formation of iron-tin alloy or iron-tin-nickel alloy during heating are prevented with an increase in the amount of metallic chromium.

Secondly, the amount of metallic tin or tin-nickel alloy, being a middle layer in the surface treated steel sheet according to the present invention should be controlled in the range of 10 to 500 mg/m$^2$, more preferably 10 to 150 mg/m$^2$. If the amount of metallic tin or tin-nickel alloy plated on the metallic chromium plated steel base is below 10 mg/m$^2$, excellent weldability is not obtained, because chromium oxide having high electrical resistance is formed by the oxidation of metallic chromium during heating for lacquer curing, even if the oxidation of a steel base is prevented by a sufficient amount of metallic chromium. The amount of the plated tin or tin-nickel alloy is limited to 500 mg/m$^2$ from an economical point of view, although the effect of metallic tin or tin-nickel alloy in the present invention does not change at above 500 mg/m$^2$.

In the present invention, tin-nickel alloy does not always means tin-nickel alloy having a stoichiometrical composition with a constant ratio of tin to nickel such as NiSn, $Ni_3Sn$, $Ni_3Sn_2$ and $Ni_3Sn_4$, but means the co-deposition of tin and nickel having various ratios of tin to nickel. However, it is said that co-deposited tin and nickel form tin-nickel alloy at room temperature or during heating.

In the case of tin-nickel alloy plating on the chromium plated steel base, the nickel content is preferably 20 to 60 weight % based on the total weight of plated tin and nickel. Although the weldability decreases slightly with an increase in the codeposited nickel content in the plated tin-nickel alloy, the surface treated steel sheet according to the present invention, wherein tin-nickel alloy is plated on the chromium plated steel base, also has excellent weldability compared with that of TFS-CT. At above 60 weight % or below 20 weight % of nickel in the tin-nickel alloy, the weldability and the corrosion resistance are excellent compared with that of IFS-CT. However, it is difficult to stably plate tin-nickel alloy having below 20 weight % and above 60 weight % of nickel on the chromium plated steel base by using a tin-nickel alloy plating electrolyte, because the nickel content or tin content in the tin-nickel alloy changes greatly with a slight change in the plating conditions.

Particularly, the surface treated steel sheet according to the present invention, wherein tin-nickel alloy is plated on the chroium plated steel base, is characterized by excellent corrosion resistance to sulfide stains, which may often appear in the inside of the can when some foods containing protein such as fish and meat are packed in the lacquered tinplate can, unlacquered tinplate can and lacquered nickel plated steel can.

Various methods for making an alloy or co-depositions layer such as the co-deposition of tin and zinc, the codeposition of tin and cobalt, nickel plating after tin plating, tin plating after nickel plating, zinc plating after tin plating and tin plating after zinc plating on the chromium plated steel base are considered in order to obtain a surface treated steel sheet having an excellent weldability, but these methods are not suitable for the production of the surface treated steel sheet having excellent weldability, because of the complexity of the process or because a special electrolyte is required.

As described above, the presence of metallic chromium as a bottom layer and metallic tin or tin-nickel alloy as a middle layer in the surface treated steel sheet according to the present invention are indispensable in order to realize excellent weldability after heating.

Furthermore, in the present invention, the presence of a small amount of hydrated chromium oxide as a top layer is indispensable in order to prevent the oxidation of the exposed steel base and the exposed metallic chromium after tin or tin-nickel alloy plating during heating for lacquer curing and to obtain excellent corrosion resistance and excellent lacquer adhesion.

The optimum range of hydrated chromium oxide is from 2 to 18 $mg/m^2$, more preferably 4 to 12 $mg/m^2$ as chromium.

If the amount of hydrated chromium oxide is below 2 $mg/m^2$ as chromium, the corrosion resistance and the lacquer adhesion become poor. If the amount of hydrated chromium oxide is above 18 $mg/m^2$, the weldability becomes remarkably poor, because hydrated chromium oxide changes to chromium oxide having high electric resistance by dehydration of it during heating for lacquer curing.

The conditions for each process in the production of the surface treated steel sheet according to the present invention are shown in detail.

At first, in order to form a metallic chromium layer as a bottom layer on the surface treated steel sheet according to the present invention, a known chromium plating electrolyte such as a Sargent bath or a chromic acid electrolyte, containing additives such as fluorine compounds and sulfur compounds, which are used for the production of TFS-CT having a lower layer of metallic chromium and an upper layer of hydrated chromium oxide, may be employed.

In the present invention, it is preferable to employ the following electrolytic chromium plating conditions for the formation of a metallic chromium layer on a steel base:

Concentration of chromic acid: 30~300 g/l, more preferably 80~300 g/l

Concentration of additive: 1.0~5.0, more preferably 1.0~3.0 weight % of concentration of chromic acid Additives: at least one compound selected from the consisting of fluorine compounds and sulfur compounds Temperature of the electrolyte: 30°~60° C.

Cathodic current density: 10~100 $A/dm^2$

Generally, the amount of hydrated chromium oxide formed during chromium plating decreases with an increase in the concentration of chromic acid in a suitable weight ratio of additives to chromic acid. It is not preferable to use an electrolyte having below 30 g/l of chromic acid for the chromium plating, because the current efficiency for the deposition of metallic chromium decreases remarkably. The concentration of chromic acid above 300 g/l is not also suitable from an economical point of view.

The presence of additives such as fluorine compounds and sulfur compounds in the chromium plating electrolyte is indispensable for uniform chromium deposition. If the weight of additives to chromic acid is below 1.0 or above 5.0, the current efficiency for the deposition of metallic chromium remarkably decreases, besides a decrease in an uniformity of the deposited metallic chromium layer. Particularly, at below 1.0 weight % of additives to chromic acid, the formed insoluble hydrated chromium oxide remarkably prevents the formation of a uniform metallic tin or tin-nickel alloy layer in the following tin or tin-nickel plating.

It is preferable that the additives be at least one compound selected from the group consisting of fluorine compounds such as hydrofluoric acid, fluoboric acid, fluosilicic acid, ammonium bifluoride, an alkali metal bifluoride, ammonium fluoride, an alkali metal fluoride, ammonium fluoborate, an alkali metal fluoborate, ammonium fluosilicate, an alkali metal fluosilicate, aluminum fluoride and sulfur compounds such as sulfuric acid, ammonium sulfate, an alkali metal sulfate, chromium sulfate, aluminum sulfate, phenolsulfonic acid, ammonium phenolsulfonate, an alkali metal phenolsulfonate, phenoldisulfonic acid, ammonium phenoldisulfonate, an alkali metal phenoldisulfonate, ammonium sulfite, an alkali metal sulfite, ammonium thiosulfate and an alkali metal thiosulfate.

The amount of hydrated chromium oxide formed during chromium plating decreases with an increase in the temperature of the electrolyte. The temperature of the electrolyte above 60° C. is not suitable from an industrial point of view, because the current efficiency for the deposition of metallic chromium decreases remarkably. The temperature of the electrolyte below 30° C. is not also suitable because a long time is necessary for the removal of the large amount of hydrated chromium oxide formed during chromium plating.

With an increase in a cathodic current density, the current efficiency for the deposition of metallic chromium increases and the amount of hydrated chromium oxide formed during chromium plating decreases. It is suitable in the present invention that the range of the cathodic current density for the deposition of metallic chromium be 10 to 100 A/dm$^2$, more preferably 40 to 80 A/dm$^2$, because metallic chromium almost does not deposit at below 10 A/dm$^2$ of current density and the current efficiency for the deposition of metallic chromium almost does not increase at above 100 A/dm$^2$ of current density.

In the present invention, the conditions for chromium plating wherein a good current efficiency for the deposition of metallic chromium is obtained and a small amount of hydrated chromium oxide is formed, should be selected because the presence of hydrated chromium oxide prevents the formation of a uniform tin or tin-nickel alloy layer in the following tin or tin-nickel alloy plating.

However, hydrated chromium oxide is always formed on a deposited metallic chromium layer during chromium plating.

Under the conditions of higher concentration of chromic acid, higher current density and higher temperature of the electrolyte, the amount of hydrated chromium oxide formed on the deposited metallic chromium is about 3 to 10 mg/m$^2$ as chromium. On the contrary, under the conditions of lower concentration of chromic acid, lower current density and lower temperature of the electrolyte, it is about 10 to 50 mg/m$^2$ as chromium.

When a large amount of hydrated chromium oxide is formed during chromium plating, it is possible to decrease it by leaving the chromium plated steel base in the chromium plating electrolyte for a few seconds. However, hydrated chromium oxide of about 3 to 5 mg/m$^2$ as chromium remains on the surface of the chromium plated steel base, even if the chromium plated steel base covered with hydrated chromium oxide is left in the chromium plating electrolyte for a long time.

In the present invention, such hydrated chromium oxide must be removed before the subsequent tin or tin-nickel alloy plating because the presence of hydrated chromium oxide prevents the deposition of a uniform tin or tin-nickel alloy layer on a metallic chromium layer.

The following methods are considered suitable for the removal of hydrated chromium oxide on the deposited metallic chromium layer.

(A) An immersion of the chromium plated steel base, before drying, into a high concentration of an alkaline solution such as an alkali metal hydroxide and an alkali metal carbonate at high temperatures of 70° to 90 ° C. It is difficult to industrialize this method because the alkaline solution may be mixed into the following tin or tin-nickel alloy plating electrolyte.

(B) An immersion of the chromium plated steel base before drying, into an acid solution such as sulfuric acid and hydrochoric acid. This method is not suitable in the present invention, because hydrated chromium oxide formed during chromium plating is not sufficiently dissolved by an immersion into acid solution for a short time.

(C) A mechanical removal of hydrated chromium oxide by a brushing roll or wiper in an alkaline solution or an acid solution before drying the chromium plated steel base. The hydrated chromium oxide formed on the chromium plated steel base is not uniformly removed by this method.

Therefore these methods such as (A), (B) and (C) are not suitable for the removal of hydrated chromium oxide before the following tin or tin-nickel alloy plating.

In the present invention, the following methods are preferable for the removal of hydrated chromium oxide formed on the metallic chromium layer. One is the method wherein the chromium plated steel base is cathodically treated in an acid solution such as sulfuric acid and hydrochloric acid having a pH of 0.5 to 2.0, before tin or tin-nickel alloy plating. The other is the method wherein tin or tin-nickel alloy plating is carried out at the same time with the removal of hydrated chromium oxide formed on the metallic chromium layer by using a tin plating electrolyte having a low concentration of stannous ion or a tin-nickel alloy plating electrolyte, which electrolytes have a low current efficiency for the deposition of tin or tin-nickel alloy.

The conditions for the removal of hydrated chromium oxide by the former method are as follows:

Electrolyte: An acid solution containing at least one acid selected from the group consisting of sulfuric acid, hydrochloric acid, hydrofluoric acid, fluoboric acid and fluosilicic acid having a pH of 0.5 to 2.0

Temperature of the electrolyte: 30°~70° C.

Cathodic current density: 2~50 A/dm$^2$

Treating time: 0.5~5.0 seconds

Although the main component in the electrolyte is acid such as sulfuric acid and hydrochloric acid, if the pH of the electrolyte is kept between 0.5 to 2.0, various ions which are not deposited on the surface of the chromium plated steel base or do not oxidize the surface of the chromium plated steel base, can be contained in the electrolyte. It is not necessary that the temperature of the electrolyte be strictly controlled if it is kept between 30° to 70° C.

If the temperature of the electrolyte is above 70° C., the evaporation of water is increased. At below 30° C. a cathodic treatment for a long time is required for the sufficient removal of hydrated chromium oxide.

At below 2 A/dm$^2$ of current density, hydrated chromium oxide is not sufficiently removed, even if the chromium plated steel base is cathodically treated for a long time. An upper limit of current density is limited to 50 A/dm$^2$ because the effect of the present invention is not increased at a current density above 50 A/dm$^2$.

If the treating time is below 0.5 seconds, hydrated chromium oxide is not sufficiently removed from the metallic chromium layer, even if the higher current density is applied. The treating time above 5.0 seconds is not suitable in the high speed production of the surface treated steel sheet according to the present invention.

The conditions for the latter method wherein tin or tin-nickel alloy plating is carried out at the same time with the removal of hydrated chromium oxide formed on the metallic chromium layer is as follows:

In tin plating, the following conditions are preferable.

Concentration of stannous ion: 2~10 g/l pH of the electrolyte: 0.5~3.0

Temperature of the electrolyte: 30°~60° C.

Cathodic current density: 3~50 A/dm$^2$

Generally, a tin plating electrolyte such as a ferrostan bath and a halogen bath having about 20 to 40 g/l of stannous ion is used for the industrial production of electrotinplate. It is not suitable that these tin plating electrolytes are used for tin plating on the chromium plated steel base without the removal of hydrated chromium oxide formed during chromium plating in the latter method, because a uniform tin layer is not formed on the chromium plated steel base and the coarsely and dendritically plated tin may be peeled off from the chromium plated steel base, although these tin plating electrolytes can be used for tin plating after the removal of hydrated chromium oxide on the chromium plated steel base by a cathodic treatment in an acidic solution.

In latter method, tin plating with the removal of hydrated chromium oxide formed during chromium plating is characterized by the use of tin plating electrolyte having a low concentration of stannous ion such as 2 to 10 g/l, namely having a low current efficiency for the deposition of tin.

The reason why a uniform tin layer is not formed on the chromium plated steel base by using a known tin plating electrolyte having a high concentration of stannous ion is that a greater part of the quantity of electricity is consumed for the deposition of tin, but is not consumed for the removal of hydrated chromium oxide.

Therefore it is desirable to decrease the concentration of stannous ion to below 10 g/l in the present invention in order to obtain a uniform tin layer on the chromium plated steel base.

However, a concentration of stannous ion below 2 g/l is not suitable in the present invention, because the current efficiency for the deposition of tin decreases remarkably and becomes unsuitable due to the presence of a small amount of ions such as chromium ion and iron ion which build up in the electrolyte by a dissolution of the hydrated chromium oxide and the steel base.

Stannous ion is mainly supplied by the addition of stannous sulfate, stannous chloride, stannous fluoride and stannous fluoborate or by the dissolution of a soluble tin anode.

The pH of the electrolyte is also very important for tin plating on the chromium plated steel base with the removal of hydrated chromium oxide formed during chromium plating. The pH range of the electrolyte should be from 0.5 to 3.0, preferably 0.5 to 1.5 in the ferrostan bath containing sulfuric acid or phenolsulfonic acid or preferably 2 to 3 in the halogen bath containing stannous chloride, sodium fluoride, potassium bifluoride and sodium chloride.

At a low pH such as 0.5 to 3.0, the surface of the chromium plated steel base is uniformly activated because hydrated chromium oxide formed during chromium plating is easily removed from the chromium plated steel base with the evolution of a large amount of hydrogen during dissolution by acid. Therefore a uniform metallic tin layer is formed on the metallic chromium layer. A pH of below 0.5 is not desirable in the present invention, because a part of metallic chromium may be dissolved. A pH of above 3.0 is not also desirable because a uniform tin layer is not formed on the metallic chromium layer by the insufficient dissolution of hydrated chromium in a short time. Furthermore, it is difficult to stably produce the surface treated steel sheet according to the present invention because the pH of the electrolyte changes greatly by a slight change in the concentration of stannous ion and acid.

The pH of the electrolyte is mainly controlled by the addition of sulfuric acid, phenolsulfonic acid, hydrochloric acid, hydrofluoric acid, fluoboric acid, fluosilicic acid and alkali metal salts thereof. Various ions, which do not have bad effects in tin plating and on the dissolution of hydrated chromium oxide, may be contained in the electrolyte, if the pH of the electrolyte is kept in the range of from 0.5 to 3.0.

Additives such as ethoxylated $\alpha$-naphthol sulfonic acid, ethoxylated $\alpha$-naphthol, $\beta$-naphthol and gelatine which are used in a known tin plating electrolyte such as a ferrostan bath or halogen bath for the production of electrotinplate can be used for the improvement of the uniformity of the plated tin layer in the present invention.

It is suitable in the present invention that the range of the cathodic current density is 3 to 50 A/dm$^2$, more preferably 10 to 30 A/d m$^2$. If the current density is below 3 A/dm$^2$, the current efficiency for tin plating becomes so low that a long time is necessary for the deposition of the required amount of tin. If the current density is above 50 A/dm$^2$, a tin layer having excellent adhesion to the chromium plated steel base is not obtained.

The optimum range for the temperature of the electrolyte is from 30° to 60° C., more preferably 30° to 50° C. At below 30° C., hydrated chromium oxide is not dissolved sufficiently, so that the uniform tin layer is not plated on the chromium plated steel base. At above 60° C., a part of metallic chromium is dissolved with the dissolution of hydrated chromium oxide.

In tin-nickel alloy plating with the removal of hydrated chromium oxide formed during chromium plating, the following two types of the electrolyte are used. The first type of the electrolyte is a pyrophosphate bath consisting of an alkali metal pyrophosphate, stannous chloride, nickel chloride and additives. The second type of the electrolyte is a halogen bath consisting of stannous halogenide, nickel halogenide, an alkali metal halogenide and additives. It is suitable to employ the following conditions for tin-nickel alloy plating by using the first type of electrolyte:

Concentration of stannous ion: 2~40 g/l
Concentration of nickel ion: 4~20 g/l
Concentration ratio of stannous ion to nickel ion: 0.1~3
Concentration of an alkali metal pyrophosphate: 80~300 g/l
pH of the electrolyte: 8~10
Temperature of the electrolyte: 40°~60° C.
Cathodic current density: 1~30 A/dm$^2$ It is suitable to employ the following conditions for tin-nickel alloy plating by using the second type of the electrolyte:

Concentration of stannous ion: 2~70 g/l
Concentration of nickel ion: 4~80 g/l
Concentration ratio of stannous ion to nickel ion: 0.1~0.8
pH of the electrolyte: 0.5~3
Temperature of the electrolyte: 30°~60° C.
Cathodic current density: 1~30 A/dm$^2$ In tin-nickel alloy plating on the chromium plated steel base with the removal of hydrated chromium oxide by using alkaline pyrophosphate bath or acidic halogen bath, it is very important that the concentration ratio of stannous ion to nickel ion be kept within the range described above in order to obtain a uniform tin-nickel alloy layer containing 20 to 60 weight % of nickel on the chromium plated steel base.

In tin-nickel alloy plating, generally the nickel content increases under the conditions of higher current density, lower temperature of the electrolyte, lower concentrations of stannous ion and nickel ion, lower concentration ratio of stannous ion to nickel ion and higher pH of the electrolyte.

At below the lower limit of the concentration of stannous ion and nickel ion, the current efficiency for the co-deposition of tin and nickel decreases remarkably. The concentration of above the upper limit of stannous ion and nickel ion is not suitable from an economical point of view, because the loss of stannous ion and nickel ion increases. Furthermore, if the concentration ratio of stannous ion to nickel ion is below the lower limit or above the upper limit, it is difficult to plate tin-nickel alloy having 20 to 60 weight % of nickel on the chromium plated steel base.

Stannous ion and nickel ion are mainly supplied by the addition of stannous chloride and nickel chloride or by the dissolution of a soluble tin anode and nickel anode, respectively.

The pH of the electrolyte is mainly controlled by the addition of hydrochloric acid and alkali metal chloride in acidic halogen bath and by the addition of pyrophosphoric acid, alkali metal pyrophosphate, hydrochloric acid, alkali metal chloride and alkali metal hydroxide in an alkaline pyrophosphate bath.

Additives such as glycine and ethylene glycol which are used in a known tin-nickel alloy plating electrolyte can be also used for the improvement of the uniformity of the plated tin-nickel alloy layer in the present invention.

Cathodic treatment in an acidic solution having pH 0.5 to 2.0, tin or tin-nickel plating with the removal of hydrated chromium oxide formed during chromium plating described above are also applied for the dried chromium plated steel base under the same conditions described above.

In the case of tin or tin-nickel alloy plating after the removal of hydrated chromium oxide by a cathodic treatment in an acidic solution, tin or tin-nickel plating is also carried out by using the same electrolyte and the same plating conditions described above.

In this case, a known tin plating electrolyte such as a ferrostan bath and halogen bath having high concentration of stannous ion, for instance, ferrostan bath consisting of 30 g/l of stannous sulfate (as stannous ion), 30 g/l of phenolsulfonic acid (60% solution) and 6 g/l of ethoxylate α-naphthol sulfonic acid or halogen bath consisting of 30 g/l of stannous chloride (as stannous ion), 30 g/l of sodium fluoride, 50 g/l of sodium chloride and 3 g/l of gelatine can be used for tin plating after the removal of hydrated chromium oxide on the chromium plated steel base.

For the formation of hydrated chromium oxide layer as a top layer of the surface treated steel sheet according to the present invention, a known electrolyte such as the acidic chromate electrolyte used for the post-treatment of electrotinplate or a chromic acid electrolyte containing a small amount of additives such as a fluorine compound and a sulfur compound, which is used for the production of TFS-CT having a lower layer of metallic chromium and an upper layer of hydrated chromium oxide, may be employed.

In the present invention, two types of the electrolytes are used for the formation of hydrated chromium oxide. The first type of electrolyte consists of an acidic chromate electrolyte without addition of additives such as fluorine compounds and sulfur compounds. The second type of electrolyte consists of chromic acid electrolyte with additives such as fluorine compounds and sulfur compounds.

It is suitable to employ the following conditions for the formation of hydrated chromium oxide of 2 to 18 $mg/m^2$ as chromium by using the first type of electrolyte:

Concentration of hexavalent chromium ion: 5~30 g/l
Temperature of the electrolyte: 30°~70° C.
Cathodic current density: 1~20 $A/dm^2$
Quantity of electricity: 1~40 $coulombs/dm^2$ If the concentration of hexavalent chromium ion is below 5 g/l, a waste of electric power results because of the higher electrical resistance of the electrolyte. The concentration of hexavalent chromium ion is limited to 30 g/l from the viewpoint of conserving resources, although the effect of the present treatment is not decreased in a concentration above 30 g/l.

It is an essential condition that the electrolyte be acidified. In the case of alkaline electrolytes, the efficiency for the formation of hydrated chromium oxide is so low that a long time is necessary for the formation of satisfactory hydrated chromium oxide. Therefore, the electrolyte containing only a chromate of an alkali metal or ammonium is not used in the present invention.

In the above case it should be acidified by the addition of chromic acid. It is also possible to add a hydroxide of an alkali metal or ammonium to chromic acid electrolyte within an acid range.

Therefore, at least one chromate selected from the group consisting of chromic acid, a chromate and dichromate of an alkali metal, ammonium chromate and ammonium dichromate is used for the first type of the electrolyte within an acid range in the present invention. It is not necessary that the temperature of the electrolyte be strictly controlled if it is kept between 30° to 70° C.

If the temperature of the electrolyte is above 70° C., the evaporation of water is increased.

Under a current density below 1 $A/dm^2$, a long time is necessary for the formation of a satisfactory hydrated chromium oxide. Under a current density above 20 $A/dm^2$, the control in the amount of the formed hydrated chromium oxide may be difficult, although a satisfactory hydrated chromium oxide may be difficult, because a large amount of hydrated chromium oxide is formed by a cathodic treatment in a short time.

If the quantity of electricity is below 1 $coulombs/dm^2$, it is difficult to form a suitable amount of hydrated chromium oxide. At above 40 coulombs/d $m^2$ of electricity, the weldability of the surface treated steel according to the present invention becomes poor because of the formation of thicker hydrated chromium oxide.

It is desirable to employ the following conditions for the formation of hydrated chromium oxide by using the second type of electrolyte:

Concentration of chromic acid: 10~50 g/l
Weight % of additives to chromic acid: 0.2~1.0
Additives: Sulfur compound and/or fluorine compound
Temperature of the electrolyte: 30°~60° C.
Cathodic current density: 1~10 $A/dm^2$ Under the conditions described above, weight percent of additives to chromic acid and current density are very important in the present treatment, because at a higher weight percent of additives to chromic acid and higher current density, metallic chromium, which imparts a bad effect to the weldability, is deposited on the tin or tin-nickel alloy plated steel base.

Therefore the weight percent of additives to chromic acid is limited to 1.0 and a cathodic current density is limited to 10 A/dm$^2$. However, if the weight percent of additives to chromic acid is below 0.2, the weldability becomes poor because thick hydrated chromium oxide is formed. Under a current density below 1 A/dm$^2$, a long time is necessary for the formation of a satisfactory hydrated chromium oxide. Furthermore, the ranges in the concentration of chromic acid, the quantity of elcctricity and the temperature of the electrolyte are limited as in the first type of the electrolyte by the same reason.

Additives are also selected from the same group as in the chromium plating electrolyte.

In the treatment using the second type of the electrolyte, it is very important to select the conditions wherein metallic chromium is not deposited on the tin or tin-nickel alloy plated surface. However, under some conditions wherein metallic chromium is deposited, the maximum amount of metallic chromium should be limited to 10 mg,/m$^2$, although the amount of the deposited metallic chromium should be ideally zero.

The present invention is illustrated by the following examples.

In Example 1 to Example 5, a cold rolled steel sheet having a thickness of 0.22 mm was treated by the following process after electrolytically degreasing in a solution of 70 g/l of sodium hydroxide, water rinsing and then pickling in a solution of 100 g/l of sulfuric acid, followed by rinsing with water.

Chromium plating→water rinsing→tin or tin-nickel alloy plating (with the removal of hydrated chromium oxide formed during chromium plating)→water rinsing→chromate treatment→ water rinsing→drying.

In Example 6 and Example 7, the same kind of steel sheet pretreated as in Example 1 to Example 5 was treated by the following process.

Chromium plating→water rinsing→the removal of hydrated chromium oxide formed during chromium plating by a cathodic treatment in an acidic solution→ water rinsing →tin plating→water rinsing→chromate treatment→water rinsing→drying.

In each Example, the conditions were shown in detail.

EXAMPLE 1

| | |
|---|---|
| **Conditions for chromium plating** | |
| Composition of electrolyte | |
| $CrO_3$ | 120 g/l |
| $HBF_4$ | 0.8 g/l |
| $H_2SO_4$ | 0.5 g/l |
| Temperature of electrolyte | 60° C. |
| Cathodic current density | 50 A/dm$^2$ |
| **Conditions for tin plating** | |
| Composition of electrolyte | |
| $SnSO_4$ | 10 g/l as $Sn^{2+}$ |
| Phenolsulfonic acid (60% solution) | 20 g/l |
| Ethoxylated α-naphthol sulfonic acid | 5 g/l |
| pH | 1.1 |
| Temperature of electrolyte | 40° C. |
| Cathodic current density | 5 A/dm$^2$ |
| **Conditions for chromate treatment** | |
| $CrO_3$ | 50 g/l |
| $H_2SO_4$ | 0.1 g/l |
| Temperature of electrolyte | 55° C. |
| Cathodic current density | 3 A/dm$^2$ |

EXAMPLE 2

| | |
|---|---|
| **Conditions for chromium plating** | |
| Composition of electrolyte | |
| $CrO_3$ | 250 g/l |
| $H_2SO_4$ | 3 g/l |
| Temperature of electrolyte | 45° C. |
| Cathodic current density | 20 A/dm$^2$ |
| **Conditions for tin plating** | |
| Composition of electrolyte | |
| $SnSO_4$ | 3 g/l as $Sn^{2+}$ |
| Phenolsulfonic acid (60% solution) | 20 g/l |
| Ethoxylated α-naphthol sulfonic acid | 3 g/l |
| pH | 0.9 |
| Temperature of electrolyte | 45° C. |
| Cathodic current density | 8 A/dm$^2$ |
| **Conditions for chromate treatment** | |
| $Na_2Cr_2O_7.2H_2O$ | 60 g/l |
| Temperature of electrolyte | 40° C. |
| Cathodic current density | 20 A/dm$^2$ |

EXAMPLE 3

| | |
|---|---|
| **Conditions for chromium plating** | |
| Composition of electrolyte | |
| $CrO_3$ | 50 g/l |
| NaF | 2 g/l |
| Temperature of electrolyte | 55° C. |
| Cathodic current density | 40 A/dm$^2$ |
| **Conditions for tin-nickel alloy plating** | |
| Composition of electrolyte | |
| $SnCl_2$ | 50 g/l as $Sn^{2+}$ |
| $NiCl_2.6H_2O$ | 75 g/l as $Ni^{2+}$ |
| Ethylene glycol | 80 g/l |
| HCl | 30 g/l |
| Ratio of $Sn^{2+}$ to $Ni^{2+}$ | 0.67 |
| pH | 0.5 |
| Temperature of electrolyte | 45° C. |
| Cathodic current density | 10 A/dm$^2$ |
| **Conditions for chromate treatment** | |
| Composition of electrolyte | |
| $Na_2Cr_2O_7.2H_2O$ | 30 g/l |
| Temperature of electrolyte | 40° C. |
| Cathodic current density | 10 A/dm$^2$ |

EXAMPLE 4

| | |
|---|---|
| **Conditions for chromium plating** | |
| Composition of electrolyte | |
| $CrO_3$ | 100 g/l |
| HF | 3 g/l |
| Temperature of electrolyte | 60° C. |
| Cathodic current density | 30 A/dm$^2$ |
| **Conditions for tin-nickel alloy plating** | |
| Composition of electrolyte | |
| $SnCl_2$ | 26 g/l as $Sn^{2+}$ |
| $NiCl_2.6H_2O$ | 60 g/l as $Ni^{2+}$ |
| $NaHF_2$ | 35 g/l |
| NaF | 28 g/l |
| Ratio of $Sn^{2+}$ to $Ni^{2+}$ | 0.43 |
| pH | 2.9 |
| Temperature of elecrolyte | 40° C. |
| Cathodic current density | 2 A/dm$^2$ |
| **Conditions for chromate treatment** | |
| Composition of electrolyte | |
| $K_2Cr_2O_7$ | 50 g/l |
| Temperature of electrolyte | 55° C. |
| Cathodic current density | 5 A/dm$^2$ |

EXAMPLE 5

| Conditions for chromium plating | |
|---|---|
| Composition of electrolyte | |
| $CrO_3$ | 200 g/l |
| NaF | 6 g/l |
| $Na_2SiF_6$ | 1 g/l |
| Temperature of electrolyte | 50° C. |
| Cathodic current density | 40 A/dm$^2$ |
| Conditions of tin-nickel alloy plating | |
| Composition of electrolyte | |
| $SnCl_2$ | 15 g/l as $Sn^{2+}$ |
| $NiCl_2$ | 7 g/l as $Ni^{2+}$ |
| Glycine | 28 g/l |
| $K_4P_2O_7.3H_2O$ | 150 g/l |
| Ratio of $Sn^{2+}$ to $Ni^{2+}$ | 2.1 |
| pH | 8.1 |
| Temperature of electrolyte | 50° C. |
| Cathodic current density | 5 A/dm$^2$ |
| Conditions for chromate treatment | |
| Composition of electrolyte | |
| $CrO_3$ | 30 g/l |
| $Na_2SiF_6$ | 0.3 g/l |
| Temperature of electrolyte | 55° C. |
| Cathodic current density | 10 A/dm$^2$ |

EXAMPLE 6

| Conditions for chromium plating | |
|---|---|
| Composition of electrolyte | |
| $CrO_3$ | 100 g/l |
| HF | 3 g/l |
| Temperature of electrolyte | 60° C. |
| Cathodic current density | 80 A/dm$^2$ |
| Conditions for the removal of hydrated chromium oxide | |
| Composition of electrolyte | |
| $H_2SO_4$ *pH* | 0.5 |
| Temperature of electrolyte | 60° C. |
| Cathodic current density | 20 A/dm$^2$ |
| Treating time | 0.5 seconds |
| Conditions for tin plating | |
| Composition of electrolyte | |
| $SnSO_4$ | 30 g/l as $Sn^{2+}$ |
| Phenoldisulfonic acid (60% solution) | 25 g/l |
| Ethoxylated α-naphthol | 6 g/l |
| pH | 0.8 |
| Temperature of electrolyte | 40° C. |
| Cathodic current density | 15 A/dm$^2$ |
| Conditions for chromate treatment | |
| Composition of electrolyte | |
| $K_2Cr_2O_7$ | 20 g/l |
| Temperature of electrolyte | 40° C. |
| Cathodic current density | 5 A/dm$^2$ |

EXAMPLE 7

| Conditions for chromium plating | |
|---|---|
| Composition of electrolyte | |
| $CrO_3$ | 40 g/l |
| NaF | 1.5 g/l |
| Temperature of electrolyte | 55° C. |
| Cathodic current density | 30 A/dm$^2$ |
| Conditions for the removal of hydrated chromium oxide | |
| Composition of electrolyte | |
| HCl pH | 1.5 |
| Temperature of electrolyte | 45° C. |
| Cathodic current density | 5 A/dm$^2$ |
| Treating time | 3 seconds |
| Conditions for tin plating | |
| Composition of electrolyte | |
| $SnCl_2$ | 28 g/l as $Sn^{2+}$ |

-continued

| | |
|---|---|
| NaF | 30 g/l |
| NaCl | 50 g/l |
| Gelatine | 3 g/l |
| pH | 2.5 |
| Temperature of electrolyte | 60° C. |
| Cathodic current density | 15 A/dm$^2$ |
| Conditions for chromate treatment | |
| Composition of electrolyte | |
| $Na_2Cr_2O_7.2H_2O$ | 30 g/l |
| Temperature of electrolyte | 60° C. |
| Cathodic current density | 3 A/dm$^2$ |

COMPARATIVE EXAMPLE 1

The same kind of steel sheet pretreated as in Example 1 was treated under the following conditions and was then rinsed with water and dried.

| Conditions of electrolytic chromic acid treatment | |
|---|---|
| Composition of electrolyte | |
| $CrO_3$ | 80 g/l |
| $HBF_4$ | 0.5 g/l |
| $H_2SO_4$ | 0.5 g/l |
| Temperature of electrolyte | 45° C. |
| Cathodic current density | 20 A/dm$^2$ |

COMPARATIVE EXAMPLE 2

The same kind of steel sheet pretreated as in Example 1 was plated with tin under the following conditions.

| Conditions for tin plating | |
|---|---|
| Composition of electrolyte | |
| $SnSO_4$ | 30 g/l as $Sn^{2+}$ |
| Phenolsulfonic acid (60% solution) | 20 g/l |
| Ethoxylated α-naphthol | 5 g/l |
| pH | 0.8 |
| Temperature of electrolyte | 40° C. |
| Cathodic current density | 8 A/dm$^2$ |

After rinsing with water, the tin plated steel sheet was treated under the following conditions and was then rinsed with water and dried.

| Conditions for chromate treatment | |
|---|---|
| Composition of electrolyte | |
| $Na_2Cr_2O_7.2H_2O$ | 30 g/l |
| Temperature of electrolyte | 60° C. |
| Cathodic current density | 10 A/dm$^2$ |

COMPARATIVE EXAMPLE 3

The same kind of steel sheet pretreated as in Example 1 was plated with tin under the same conditions as in Comparative Example 2. After rinsing with water, the tin plated steel sheet was treated under the same conditions as in Comparative Example 1 and was then rinsed with water and dried.

The weldability, lacquer adhesion and corrosion resistance of the thus treated steel sheet in the above described Examples and Comparative examples were evaluated by the following testing methods after the measurements of the amounts of metallic chromium, metallic tin, metallic nickel and chromium in the hydrated chromium oxide by the fluorescent X-ray method.

The results are shown in the attached Table.

(1) Weldability

The weldability is usually evaluated by an available range of secondary current in welding as shown in the report by N. T. Williams (Metal Construction, April 1977, page 157~160), that is to say, the wider the secondary current range in welding, the better the weldability. The upper limit in the available secondary current range corresponds to the welding conditions in which some defect such as splashing is found and the lower limit corresponds to the welding conditions in which the breakage occurs in the welded part by tearing tests.

However, in order to determine the available range of secondary current in welding to be used in each sample, a large number of samples are necessary.

Therefore, the weldability was evaluated by the electric contact resistance according to the following methods, because the electrical contact resistance has an apparent correlation to the available range of secondary current in welding as shown in the report by T. Fujimura (Journal of The Iron and Steel Institute of Japan, Vol. 69, No. 13, September 1983, page 181), that is, the lower the electric contact resistance, the wider the secondary current range in welding. Accordingly, if the electric contact resistance is lower, the weldability is better.

At first, the sample was cut to a size of 20 mm×100 mm after baking at 210° C. for 20 minutes.

The electrical contact resistance of the sample was calculated from the change of voltage between a pair of copper disk electrodes (diameter: 65 mm, thickness 2 mm) wherein 5 amperes of direct current was employed and 50 kg of load was added, when a pair of samples were inserted into between a pair of the copper disk electrodes rotating at 5 m/min.

(2) Lacquer Adhesion

The sample was baked at 210° C. for 12 minutes after coating with 60 mg/dm$^2$ of an epoxy-phenolic type of lacquer. The coated sample was cut into a circular blank having a diameter of 80 mm by a punch press, and the blank was deeply drawn to form a cup.

The lacquer film in the side wall of a cup was peeled off by an adhesive tape. The adhesion of the lacquer film was divided into 5 ranks, namely, 5 was excellent, 4 was good, 3 was fair, 2 was poor and 1 was bad.

(3) Corrosion Resistance After Lacquer Coating

The sample was baked at 210° C. for 12 minutes after coating with 60 mg/dm$^2$ of an epoxy-phenolic type of lacquer. The coated sample was immersed into the solution containing 1.5% of citric acid and 1.5% of sodium chloride for 7 days at 50° C., after the surface of the coated sample was cross-hatched by a razor.

The corrosion in the scratched part of the coated sample was divided into 5 ranks, namely, 5 was excellent, 4 was good, 3 was fair, 2 was poor and 1 was bad.

TABLE

| | Ex. 1 | Ex. 2 | Ex. 3 | Ex. 4 | Ex. 5 | Ex. 6 | Ex. 7 | Comp. Ex. 1 | Comp. Ex. 2 | Comp.*3 Ex. 3 |
|---|---|---|---|---|---|---|---|---|---|---|
| *1Process | A | A | A | A | A | B | B | — | — | — |
| *2Amount of Cr° (mg/m$^2$) (Bottom layer) | 33 | 120 | 105 | 78 | 151 | 291 | 115 | 121 | — | 128 |
| Amount of Sn & Ni (mg/m$^2$) (Middle layer) | Sn 492 Ni 0 | Sn 35 Ni 0 | Sn 324 Ni 86 | Sn 64 Ni 42 | Sn 6 Ni 7 | Sn 15 Ni 0 | Sn 31 Ni 0 | — | Sn 38 Ni 0 | Sn 34 Ni 0 |
| *2 Amount of $Cr^{ox}$ (mg/m$^2$) (Top layer) | 18 | 8 | 12 | 8 | 6 | 4 | 10 | 8 | 7 | 8 |
| Electric contact resistance (mΩ) | 5 | 2 | 10 | 18 | 15 | 1 | 4 | 321 | 150 | 301 |
| Lacquer adhesion | 4 | 4 | 5 | 5 | 5 | 5 | 4 | 5 | 4 | 5 |
| Corrosion resistance | 4 | 5 | 5 | 5 | 5 | 5 | 5 | 5 | 4 | 4 |

Remarks

*1 Process A Chromium plating → Water rinsing → Tin or tin-nickel alloy plating → Water rinsing → Chromate treatment → Water rinsing → Drying Process B Chromium plating → Water rinsing → Cathodic treatment in acid solution → Tin or tin-nickel alloy plating → Water rinsing → Chromate treatment → Water rinsing → Drying

*2 $Cr^2$ shows metallic chromium and $Cr^{ox}$ shows Cr in hydrated chromium oxide.

*3 A bottom layer is metallic tin and middle layer is metallic chromium in Comp. ex. 3.

We claim:

1. A surface treated steel sheet consisting of a steel base having three layers thereon in the following order: a bottom layer of 30 to 300 mg/m$^2$ of metallic chromium, a middle layer of 10 to 500 mg/m$^2$ of metallic tin or 10 to 500 mg/m$^2$ of tin-nickel alloy containing 20 to 60 weight % of nickel and a top layer of hydrated chromium oxide of 2 to 18 mg/m$^2$ as chromium.

2. The surface treated steel sheet according to claim 1, wherein the amount of metallic chromium in said bottom layer is from 70 to 150 mg/m$^2$, the amount of metallic tin or tin-nickel alloy being from 50 to 300 mg/m$^2$ and the amount of hydrated chromium oxide in said top layer being from 4 to 12 mg/m$^2$ as chromium.

* * * * *

UNITED STATES PATENT AND TRADEMARK OFFICE

CERTIFICATE OF CORRECTION

PATENT NO. : 4,578,319

DATED : March 25, 1986

INVENTOR(S) : Nobuyoshi SHIMIZU et al.

It is certified that error appears in the above-identified patent and that said Letters Patent is hereby corrected as shown below:

On the cover page change:

"[62] Division of Serial No. 608,088, May 8, 1985" to

--[62] Division of Serial No. 608,088, May 8, 1984--.

Signed and Sealed this

*Fifth* Day of *August 1986*

[SEAL]

*Attest:*

DONALD J. QUIGG

*Attesting Officer*

*Commissioner of Patents and Trademarks*